US008525408B2

(12) United States Patent
Matsushima et al.

(10) Patent No.: US 8,525,408 B2
(45) Date of Patent: Sep. 3, 2013

(54) SHORT ARC TYPE DISCHARGE LAMP

(75) Inventors: Takeo Matsushima, Himeji (JP); Yutaka Mune, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 19 days.

(21) Appl. No.: 12/630,111

(22) Filed: Dec. 3, 2009

(65) Prior Publication Data

US 2010/0134001 A1 Jun. 3, 2010

(30) Foreign Application Priority Data

Dec. 3, 2008 (JP) ..... 2008-308288

(51) Int. Cl.
*H01J 61/26* (2006.01)
*H01J 61/24* (2006.01)

(52) U.S. Cl.
USPC ..... 313/558; 313/559; 313/561

(58) Field of Classification Search
USPC ..... 313/553–562
See application file for complete search history.

(56) References Cited

U.S. PATENT DOCUMENTS

| | | | | |
|---|---|---|---|---|
| 2,322,421 | A * | 6/1943 | Cox | 313/318.12 |
| 3,953,755 | A * | 4/1976 | Kuus et al. | 313/561 |
| 5,712,530 | A | 1/1998 | Inoue et al. | |
| 5,961,750 | A * | 10/1999 | Boffito et al. | 148/442 |
| 7,372,201 | B1 * | 5/2008 | Roberts | 313/558 |
| 2008/0169759 | A1 * | 7/2008 | Corrazza et al. | 313/562 |

* cited by examiner

*Primary Examiner* — Karabi Guharay
*Assistant Examiner* — Nathaniel Lee
(74) *Attorney, Agent, or Firm* — Roberts Mlotkowski Safran & Cole, P.C.; David S. Safran

(57) ABSTRACT

To stabilize the illumination fluctuation rate of a short arc type discharge lamp of the type having a pair of electrodes disposed inside an arc tube in a manner of facing each other and a hydrogen getter, by absorbing hydrogen gas in an arc tube without causing a decline in the performance of the short arc type discharge lamp arising out of a hydrogen getter, the hydrogen getter is formed of a hollow container made of a material that allows the transmission of hydrogen with a getter material sealed tightly inside the hollow container, and a holder for the hydrogen getter is held on the electrode with the hydrogen getter fixed in the holder.

6 Claims, 8 Drawing Sheets

Fig. 3 (a)
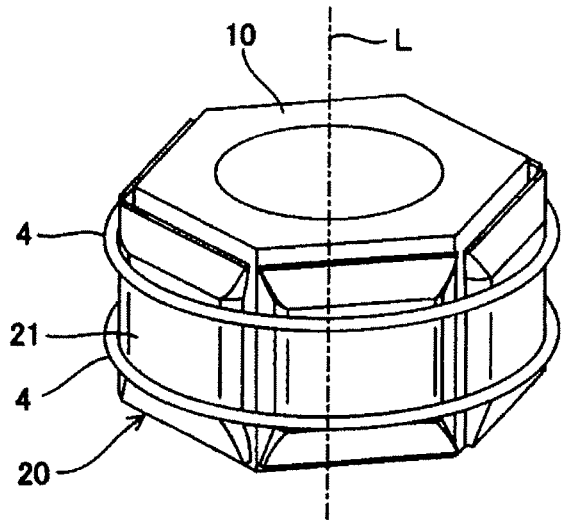
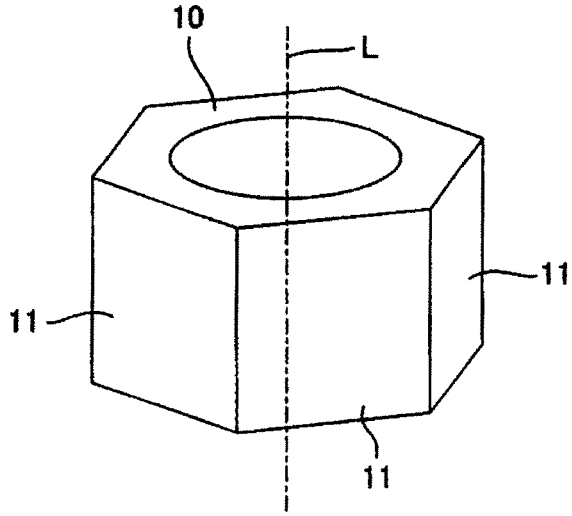
Fig. 3 (b)

(a)

Fig. 10 (Prior Art)
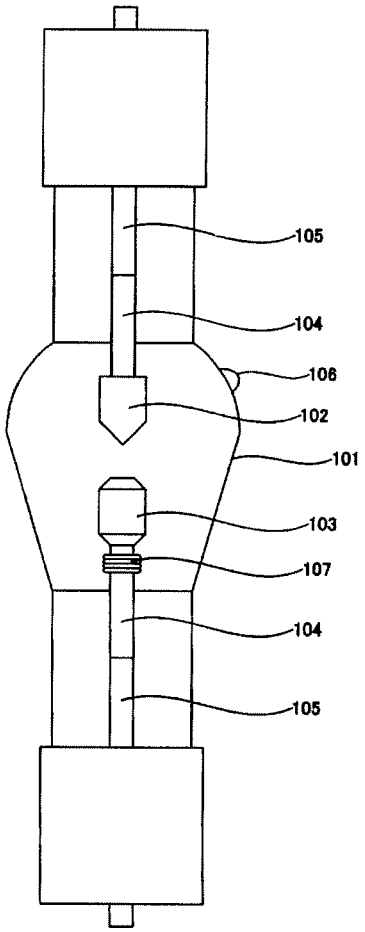
Fig. 11 (Prior Art)
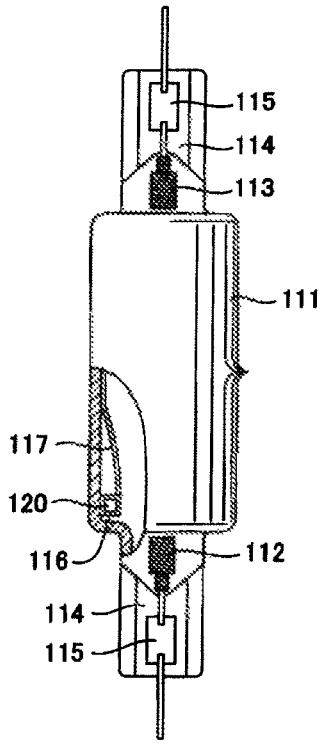
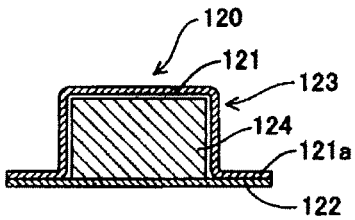
Fig. 12 (Prior Art)

SHORT ARC TYPE DISCHARGE LAMP

BACKGROUND OF THE INVENTION

1. Field of the Invention

The present invention relates to a short arc type discharge lamp used as a light source for light exposure in the field of manufacturing semiconductors and liquid crystals.

2. Description of Related Art

A short arc type discharge lamp has been used as a light source for a light exposure device having a high light collection efficiency in combination with an optical system because the distance between the tip ends of the pair of electrodes disposed inside the arc tube in a manner of facing each other is so short that it is close to a point light source.

Since the electrodes of a short arc type discharge lamp are heated to a high temperature during operation, impure compounds tend to be produced at the tip ends of the electrodes, which reach the highest temperature, if impure gas is mixed in the arc tube. As a result, the evaporation of the electrodes is accelerated. It is believed that impure gas, particularly oxygen and carbon dioxide, tends to accelerate the evaporation of the electrodes because they generate impure compounds, such as oxides and carbides on the tip end of the electrodes.

The accelerated evaporation of the electrodes causes substances evaporated from the electrodes to attach to the inner surface of the arc tube, which leads to the blackening of the arc tube. Moreover, the illumination on the light exposure surface is adversely affected, and there is some possibility that the arc spot may shift because the tip ends of electrodes are deformed due to the evaporation.

In order to absorb and capture impure gas inside the arc tube, it has conventionally been practiced that a getter is attached to an inner support rod used for supporting the electrode. There are several metals that can bring about the getter effect. Among them, the typical metal conventionally used for a short arc type discharge lamp is tantalum. It has been believed that tantalum is the best metal for use as a getter for a small-sized short arc type discharge lamp, which reaches a high temperature inside, in part because the operational temperature that brings about the getter effect is relatively high (700° C. to 1200° C.) and in part because its vapor pressure is low.

Published Unexamined Japanese Patent Application No. H8-153488 and corresponding U.S. Pat. No. 5,712,530 disclose a short arc type discharge lamp having a configuration in which a getter for capturing impurities is attached to a support rod. FIG. 10 is a view showing a schematic configuration of the conventional short arc type discharge lamp disclosed in Published Unexamined Japanese Patent Application No. H8-153488 and corresponding U.S. Pat. No. 5,712,530.

The short arc type discharge lamp as shown in the FIG. 10 has an essentially spherical arc tube 101. Inside the arc tube 101 are disposed a cathode 102 and an anode 103, each of which is supported by a support rod 104 in a manner of facing each other. A metal foil 105 is connected to each support rod 104. The reference numeral 106 is the remnant of a filling tube. A tantalum wire 107 is wound around the support rod 104 and then firmly fixed by spot welding. The temperature of the tantalum wire 107 is in the range of 1500° C. to 1700° C. during operation.

As the size of a lamp increases, a problem referred to as flicker has become obvious in such a short arc type discharge lamp, wherein the illumination fluctuation increases in the range of several milliseconds to a few tens of seconds. After intensively studying this problem, the present inventors found that the concentration of hydrogen inside the arc tube is related to this problem. However, tantalum that has conventionally been used as a getter for a short arc discharge lamp is low in hydrogen absorbing capability, and therefore, cannot absorb enough hydrogen inside the arc tube.

Published Japanese Examined Patent Application No. S57-21835 and corresponding U.S. Pat. No. 3,953,755 disclose the use of yttrium as a metal for a getter in order to remove hydrogen inside an arc tube, yttrium having an excellent hydrogen absorbing capability. FIG. 11 shows the overall structure of the discharge lamp disclosed in the literature. FIG. 12 shows a cross-sectional structure of a getter in the discharge lamp.

The discharge lamp as shown in FIG. 11 is provided with a vessel 111, a pair of electrodes 112, 113, sealing parts 114 and metal foils 115. The reference numerals 116, 117 and 120 are a quartz cylinder, a quartz stick and a hydrogen getter, respectively. As shown in FIG. 12, the hydrogen getter 120 is constituted of a metal cover 123, which is composed of a closed-end cylinder 121 made of such a metal as tantalum and a lid 122, and a getter material 124 made of cylindrical yttrium air-tightly sealed inside the metal cover 123. The inside of the metal cover 123 is air-tightly sealed by resistance welding a shoulder 121*a* of the closed-end cylinder 121 together with the lid 122. As shown in the drawing, the hydrogen getter is fixed using the quartz cylinder 116 and is fixed to the vessel 111 by welding the other end of the quartz stick 117 provided on the quartz cylinder 116 to the vessel 111. Hydrogen inside the vessel 111 infiltrates into the inner portion of the metal cover 123 made of tantalum or the like, which allows hydrogen to pass through the metal cover 123 to be absorbed by the getter material 124. The hydrogen getter 120 described in these documents can absorb hydrogen without reacting with other materials in the discharge space because the getter material 124 is sealed air-tight inside the metal cover 123.

There is some possibility, however, that the attachment of the hydrogen getter 120 to the vessel 111 as described above may cause a decline in illumination or the fracturing of the vessel because the hydrogen getter 120 may react with silica, a constituent of the vessel 111.

SUMMARY OF THE INVENTION

In view of the above-mentioned circumstances, a primary object of the present invention is to facilitate the attachment of a hydrogen getter inside the arc tube of a short arc type discharge lamp and to stabilize the illumination fluctuation rate of a short arc type discharge lamp by absorbing hydrogen gas in the arc tube without causing a decline in the performance of the short arc type discharge lamp arising out of the hydrogen getter.

The short arc type discharge lamp according to the invention has a pair of electrodes disposed inside an arc tube in a manner of facing each other and a hydrogen getter, the hydrogen getter being composed of a hollow container made of a material that allows transmission of hydrogen and a getter material contained inside the hollow container in an air-tight manner, wherein a holder for the hydrogen getter is provided on the electrode and the hydrogen getter is fixed in the holder.

In accordance with other features of the short arc type discharge lamp according to the invention, the hollow container is a straight tube or curved tube, the holder is provided with a planar part or a primary curved surface part for fixing the hydrogen getter or the holder is provided with a recess or a hole for fixing the hydrogen getter.

In accordance with further features of the short arc type discharge lamp according to the invention, the holder is made of tungsten, molybdenum or tantalum, a tungsten compound, a tungsten mixture, a molybdenum compound, a molybdenum mixture, a tantalum compound or a tantalum mixture. Alternatively, the holder is made of ceramic or glass, aluminum oxide, zirconium oxide or quartz glass.

The short arc type discharge lamp according to the invention, by being provided with a hydrogen getter inside an air-tight hollow container that allows transmission of hydrogen fixed on a holder, the following effects can be expected.

Hydrogen released into the arc tube is reliably absorbed by the hydrogen getter, resulting in a reduction in the concentration of hydrogen inside the arc tube. Therefore, the illumination fluctuation rate of a short arc type discharge lamp can stably be maintained.

Since a hydrogen getter is fixed on a holder, a hollow container in which the getter material is air-tightly sealed does not react with silica, a constituent of the arc tube. Accordingly, there is no possibility of causing various problems, such as a decline in the illumination of the short arc type discharge lamp and fracturing of its arc tube.

Moreover, since a hydrogen getter is fixed on a holder, the hydrogen getter can easily be attached inside the arc tube. The attachment of the hydrogen getter in the arc tube is markedly easier as compared with the direct attachment of a hydrogen getter to an electrode component, such as parts holding the electrode and parts used for assuring air tightness.

Furthermore, since the hydrogen getter and the holder for fixing the hydrogen getter are independent of the electrode, the process for making the getter material sealed air-tightly, activated or the like can be performed independently of the process of degassing the electrode and the like. Accordingly, there is no possibility that the hollow container is damaged by an increased inner pressure of the hollow container, which is caused by the expansion or evaporation of the getter material arising out of the temperature at the time of degassing the electrode, by way of example.

A hollow tube that is straight can handily be produced by sealing both ends of the straight tube and deforming it to the intended cross-sectional shape. A hollow tube that is curved can easily be fixed on a holder.

By the holder being provided with a planar part or a primary curved surface part for fixing the hydrogen getter, the hydrogen getter can reliably be fixed on the holder by making use of the plane part or primary curved surface part of the holder.

Since the holder is provided with a recess or hole for fixing the hydrogen getter, the hydrogen getter can reliably be fixed on the holder by fitting the hydrogen getter into the recess or hole of the holder.

By making the holder of tungsten, molybdenum or tantalum, a tungsten compound, a tungsten mixture, a molybdenum compound, a molybdenum mixture, a tantalum compound or a tantalum mixture or of a ceramic or glass, the discharge of the short arc type discharge lamp can be stabilized because there is no possibility that the holder evaporates or reacts with the emission material even if the short arc type discharge lamp is heated to a high temperature during operation.

By forming the holder of aluminum oxide, zirconium oxide or quartz glass whose thermal conductivity is low, the hydrogen getter can be kept at a low temperature even if the short arc type discharge lamp is heated to a high temperature during operation. Since the hydrogen getter has an increased capability of absorbing hydrogen at a relatively low temperature, hydrogen can be captured more efficiently.

BRIEF DESCRIPTION OF DRAWINGS

FIG. 3 is an explanatory view showing a holder for a hydrogen getter in detail.

FIG. 10 shows a schematic configuration of a conventional short arc type discharge lamp.

FIG. 11 shows a schematic configuration of a conventional short arc type discharge lamp.

FIG. 12 is sectional view of the conventional hydrogen getter as shown in FIG. 11.

DETAILED DESCRIPTION OF THE INVENTION

Figure 1:
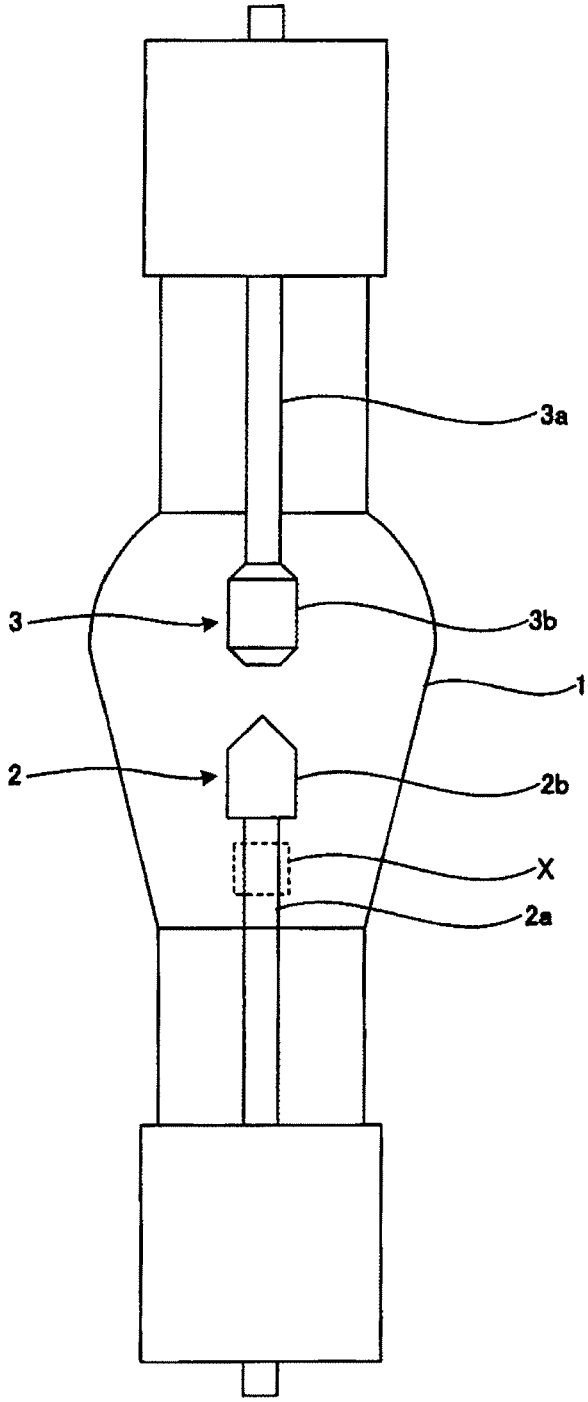
FIG. 1 shows a schematic configuration of a short arc type discharge lamp according to the present invention.

FIG. 1 shows a schematic configuration of the short arc type discharge lamp according to the present invention provided with an arc tube 1 that is substantially spherical. Inside the arc tube 1, the main body 2*b* of a cathode 2 and the main body 3*b* of an anode 3 are disposed in a manner facing each other with a luminous material sealed inside.

The emission material is a rare gas. As an example, xenon gas of at least 0.5 MPa (at room temperature) is sealed. Alternatively, at least one of xenon gas, argon gas and krypton gas may be sealed at 0.01 to 1 MPa (at room temperature). Mercury of at least 1 mg/cm$^3$ may also be sealed as an emission material.

The cathode 2 is constituted of a main body 2*b*, which has a tapered portion at its end that is gradually reduced in its diameter as it moves toward the main body 3*b* of the anode 3, and a rod-shaped shank 2*a* connected to the distal side of the main body 2*b*. The tip end of the shank 2*a* is fitted into a closed end hole formed on the distal side of the main body 2*b*.

The anode 3 is constituted of the main body 3*b*, which has a round or circular truncated cone portion at its tip end. The tip end of the shank 3*a* is fitted into a closed-end hole (blind bore) formed on the distal side of the main body 3*b*.

The cathode 2 and the anode 3 are comprised of the main body 2*b*, 3*b*, respectively, that are made of tungsten or the like and of the shank 2*b*, 3*b*, respectively. In the cathode 2 or the anode 3, the main body 2*b* or the main body 3*b* and the shank 2*a* or the shank 3*a*, respectively, may be formed of separate members. Alternatively, each main body and shank may be integrally formed. The tip end of each shank 2*a*, 3*a* may be fitted into a blind bore formed on the distal side of each main body 2*b*, 3*b*, respectively.

Figure 2:
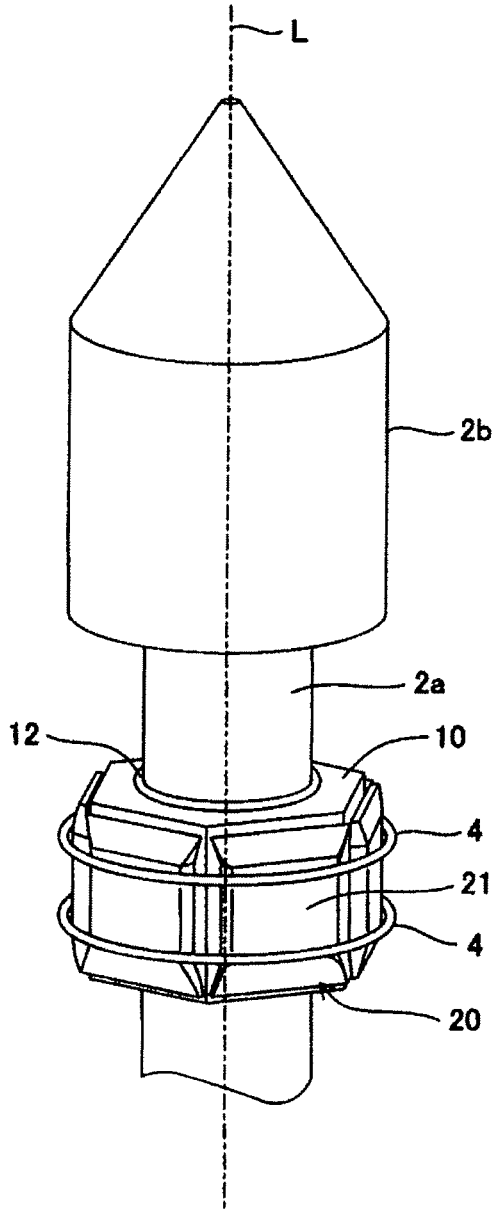
FIG. 2 is a partial explanatory view of the short arc type discharge lamp according to the present invention.

FIG. 2 is a partial explanatory view, which enlarges the portion X in FIG. 1. The drawing shows a holder 10 for holding a hydrogen getter on the shank 2*a* and a hydrogen getter 20 fixed on the holder 10. FIGS. 3(*a*) & 3(*b*) are explanatory views showing the holder 10 in detail. FIG. 3(*a*) shows the hydrogen getter 20 fixed on the side surfaces of the holder 10. FIG. 3(*b*) shows only the holder 10. For the sake of convenience, only a description of the shank 2*a* of the cathode 2 is given below.

The cylindrical holder 10 is disposed in such a way as to surround the side peripheral surface of the shank 2*a* and is held on the shank 2*a* by a pair of ring-shaped positioning members 12, which are formed at two places on the shank 2*a* that are spaced from each other in a manner of sandwiching the top and bottom of the holder 10 between them, so that movement of the hold 10 is controlled in the longitudinal direction of the shank 2*a*.

The side surface(s) of the holder 10 may be formed of planar surfaces or as a primary curved surface depending on the shape of the hollow container 21 of the hydrogen getter 20. As an example, the holder 10 may be formed to have six planar surfaces 11 as shown in FIG. 3(*b*), such that a cross-section in a direction orthogonal to an axial line L of the cathode 2 is hexagonal.

As shown in FIG. 2, a hydrogen getter 20 is disposed on each planar surface 11 of the holder 10 in a sequential arrangement in a manner surrounding the side surfaces of the holder 10 and are fixed on each side surface 11 by a plurality of fixing members 4, which are spaced from each other in the axial direction L and are wound around the hollow containers 21 in a manner surrounding all the hollow containers 21. There is no possibility that hydrogen getters 20 can fall downward because each hydrogen getter is fixed on each side surface 11 of the holder by the fixing members 4. The hydrogen getter 20 may be fixed on the holder 10 as well by welding.

The holder 10 for the hydrogen getter 20 is made of tungsten, molybdenum, tantalum or the like. Tungsten, molybdenum or tantalum may be used as such or as a compound or mixture with other materials. Alternatively, the holder 10 may be made of a wide variety of ceramics and glass materials.

Moreover, the holder 10 may be made of aluminum oxide, zirconium oxide, quartz glass or the like whose thermal conductivity is low. By making the holder 10 of such materials, the hydrogen getter 20 can be kept at a relatively low temperature, even if the electrodes 2, 3 of the short arc type discharge lamp are heated to a high temperature during operation, because heat is transmitted to the hydrogen getter 20 via the holder 10 whose thermal conductivity is low. The getter material 22 is sealed inside the hollow container 21 of the hydrogen getter 20 in an air-tight manner which increases its ability to absorb hydrogen at a lower temperature. Accordingly, hydrogen inside the arc tube can be captured efficiently by making the holder 10 of the above-mentioned materials having a low thermal conductivity.

In the abovementioned embodiment, a plurality of hydrogen getters 20 is disposed on side surfaces 11 of the holder 10 without being superimposed on each other. The present invention is not limited to this embodiment, however. A plurality of hydrogen getters may be disposed in a manner superimposed on each other. Alternatively, only one hydrogen getter may be fixed on the side surface of the holder 10.

Figure 4:
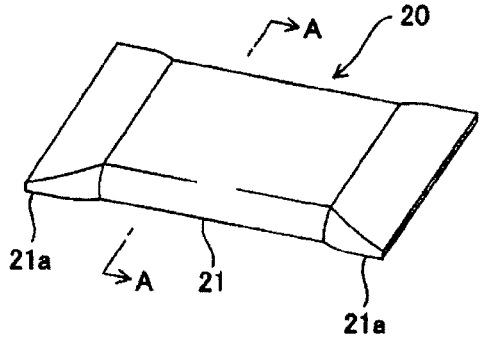
FIG. 4 is an explanatory view showing a hydrogen getter in detail.
Figure 4:
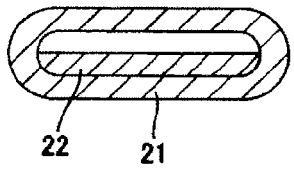

FIGS. 4(*a*) & 4 (*b*) are explanatory views showing the form of the hydrogen getter 20. FIG. 4 (*a*) is a perspective view. FIG. 4 (*b*) is a sectional view of FIG. 4 (*a*) taken along line A-A.

The hydrogen getter has a hollow container 21 made of a metal that allows hydrogen to be transmitted through it and a getter material 22 that is sealed air-tight inside of the hollow container 21. The hollow container is a straight tube with a sealing part 21*a* on both ends as shown in FIG. 4(*a*), the sealing part gradually tapering towards its end part so as to air-tightly seal the container. The cross-section of the hollow container has a flat shape as shown in FIG. 4(*b*). Each sealing part 21*a* is formed by carrying out cold pressure welding on both ends of a straight tube member, for example.

The hollow container 21 does not necessarily need to have its both ends sealed. Only one end may be sealed if a cylindrical member having a closed end is used, for example. Alternatively, a sealing part that is sealed air-tight may be formed by welding the end part of the hollow container 21.

In addition, the hollow container 21 is made of a metal that allows the transmission of hydrogen and hardly reacts with mercury, such as tantalum and niobium. Tantalum and niobium may be used as such or as a compound with other materials. By making the hollow container 21 of these materials, hydrogen can be transmitted efficiently. In addition, there is no possibility that the getter material 22 air-tightly sealed inside the hollow container 21 will react with the discharge medium, such as mercury. Furthermore, oxygen and carbon monoxide generated inside the arc tube shown in FIG. 1 are blocked by the hollow container 21 so that an oxide film cannot be formed on the surface of the getter material 22. Accordingly, the ability to capture hydrogen never declines.

The getter material 22 includes yttrium and zirconium. Yttrium and zirconium can capture hydrogen efficiently because they have an excellent ability to absorb hydrogen. Yttrium and zirconium may be used as such or as a compound with other materials. The getter material 22 may be 1 g of yttrium, for example.

The abovementioned short arc type discharge lamp according to the present invention is provided with a hydrogen getter 20 having a getter material 22 sealed air-tight inside of a hollow container 21 that allows the transmission of hydrogen and a holder 10 for the hydrogen getter held on an electrode (2, 3). The hydrogen getter 20 is fixed on the holder 10. Accordingly, the following effects can be expected.

First, hydrogen released in the arc tube 1 is transmitted through the hollow container 21 and is absorbed by the hydrogen getter 22 resulting in a reduction in the concentration of hydrogen inside the arc tube 1. Therefore, the illumination fluctuation rate of the short arc type discharge lamp can be stably maintained.

Second, the hollow container 21 in which the getter material 22 is air-tightly sealed does not react with silica, a constituent of the arc tube 1. Accordingly, there is no possibility of causing various problems, such as a decline in the illuminance of the short arc type discharge lamp and the fracturing of the arc tube.

Third, since the hydrogen getter 20 is held on the holder 10, the hydrogen getter 20 can easily be attached inside of the short arc type discharge lamp. The attachment of a hydrogen getter to the arc tube is markedly easier as compared with the direct attachment of a hydrogen getter to an electrode part, parts holding the electrode and parts used for assuring air tightness.

Fourth, since the hydrogen getter 20 and the holder 10 are independent of the electrode 2, 3, there is the advantage that the process of making the getter material 22 sealed air-tight, activated or the like can be performed independently of the process of degassing of the electrode 2, 3 and the like in the production of short arc type discharge lamps. Accordingly, there is no possibility that the hollow container is damaged by an increased inner pressure of the hollow container, which is caused by the expansion or evaporation of the getter material arising out of the temperature at the time of degassing of the electrode 2, 3, by way of example.

Figure 5:
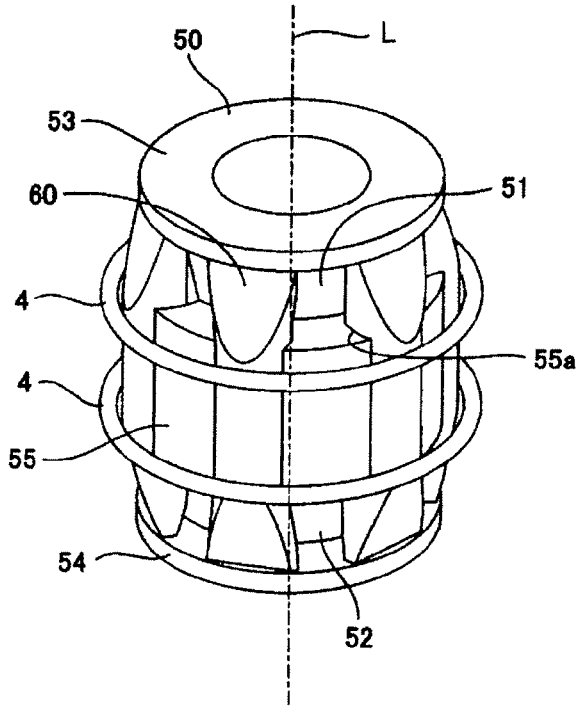
FIG. 5 is an explanatory view showing another embodiment of a holder for a hydrogen getter in detail.
Figure 6:
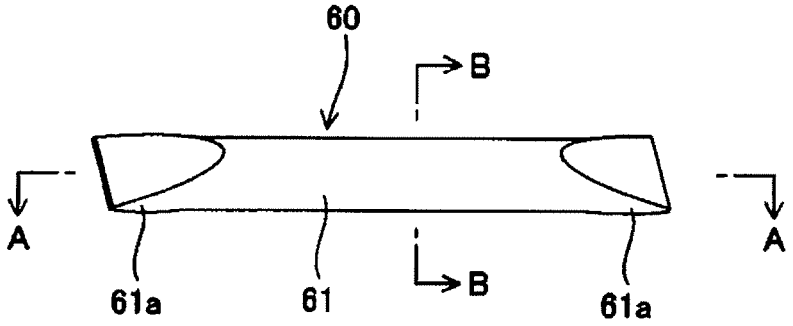
FIG. 6 is an explanatory view showing another embodiment of a hydrogen getter in detail.
Figure 6:
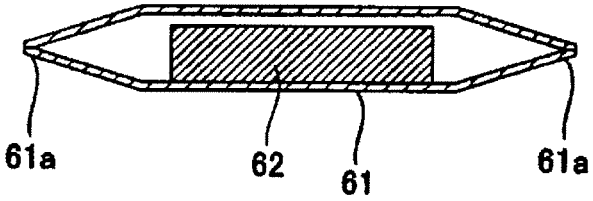
Figure 6:
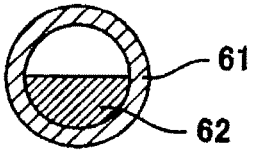

FIG. 5 is an explanatory view showing another embodiment of a holder for a hydrogen getter. In FIG. 5, the reference numerals 4, 50 and 60 are a fixing member, a holder and a hydrogen getter, respectively. FIGS. 6(*a*)-(*c*) are explanatory views showing the construction of the hydrogen getter. FIG. 6(*a*) is a perspective view. FIG. 6(*b*) is a sectional view of FIG. 6(*a*) taken along line A-A. FIG. 6(*c*) is a sectional view of FIG. 6(*a*) taken along line B-B.

In FIG. 5, a holder 50 is comprised of ring-shaped recesses 51, 52, which are formed at two places spaced from each other in the direction of axial line L of a cathode 2, a pair of shoulders 53, 54 formed on both axial ends, and a body 55 spaced from the shoulders 53, 54 by the ring-shaped recesses 51, 52. On the body 55 is found a plurality of circumferentially spaced, axially extending recesses 55*a*. Each hydrogen getter 20 is disposed in a respective recess 55*a* formed in the body 55 in a sequential arrangement in a manner surrounding the body 55 and fixed on the body 55 of the holder 50 by a plurality of fixing members 4, which are axially spaced from each other and wound around the body 55 of the holder 50 in a manner of surrounding the hollow containers 61 of all the hydrogen getters 60.

There is no possibility that hydrogen getters 60 will fall down because each hydrogen getter is fixed on the side surface of the body 55 of the holder 50 by the fixing member 4. Thus, a plurality of hydrogen getters 60 can easily be fixed on the holder 50 by forming a plurality of recesses 55*a* on the body 55 of the holder 50.

The hydrogen getter 60 fixed on the holder 50 has sealing parts 61*a* on both ends as shown in FIG. 6(*a*), the sealing parts gradually tapering toward its end part to air-tightly seal the hydrogen getter, and is formed of a hollow straight-tube container 61 of circular cross section and a getter material 62 sealed air-tight inside of the hollow container 61, as shown in FIG. 6(*c*). The hollow container 61 and the getter material 62 are equivalent to the hollow container 21 and the getter material 22 in the abovementioned hydrogen getter 20, respectively.

Figure 7:
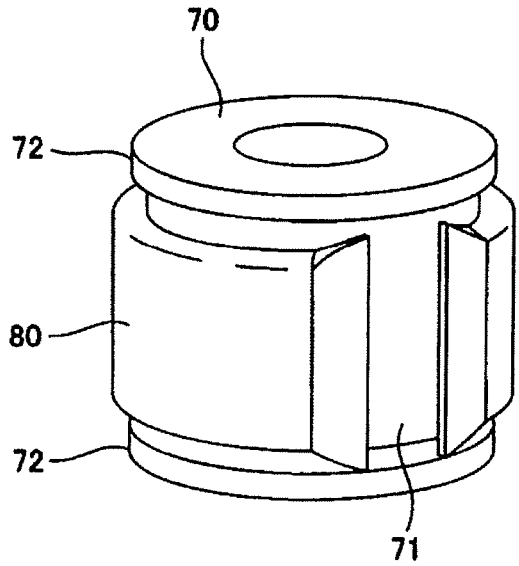
FIG. 7 is an explanatory view showing another embodiment of a holder for a hydrogen getter in detail.
Figure 8:
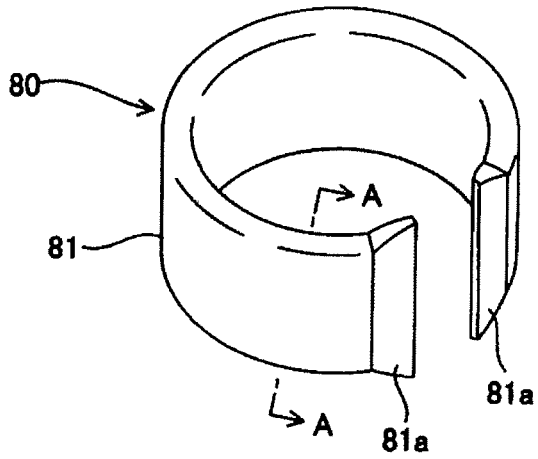
FIG. 8 is an explanatory view showing another embodiment of a hydrogen getter in detail.
Figure 8:
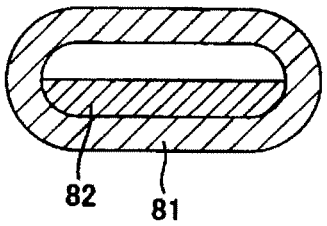

FIGS. 7 & 8 are explanatory views showing another embodiment of a holder for a hydrogen getter. In FIG. 7, a holder 70 and a hydrogen getter 80 are shown. FIG. 8(*a*) is a perspective view of the hydrogen getter 80 and FIG. 8(*b*) is a sectional taken along line A-A in FIG. 8(*a*).

As shown in FIG. 8(*a*), the hydrogen getter 80 is formed of a hollow flat container 81, which is C-shaped as a whole, and a getter material 82 sealed inside the hollow container 81 in an air-tight manner, the hollow flat container having sealing parts 81*a* formed on both ends in a tapered form.

As shown in FIG. 7, the holder 70 is formed of a cylindrical body 71 having flanged shoulders 72 formed on both ends of the body 71 in a continuous arrangement, wherein the outer diameter of the shoulders is larger than the side surface portion of the body 71 between them. The hydrogen getter 80 is fixed in a manner surrounding the side surface portion of body 71. There is no possibility of the hydrogen getter falling off because of the shoulders 72 formed on the upper and lower portions of the holder 70. It goes without saying that the hydrogen getter 80 and the body 71 may integrally be fixed by welding, for example.

Figure 9:
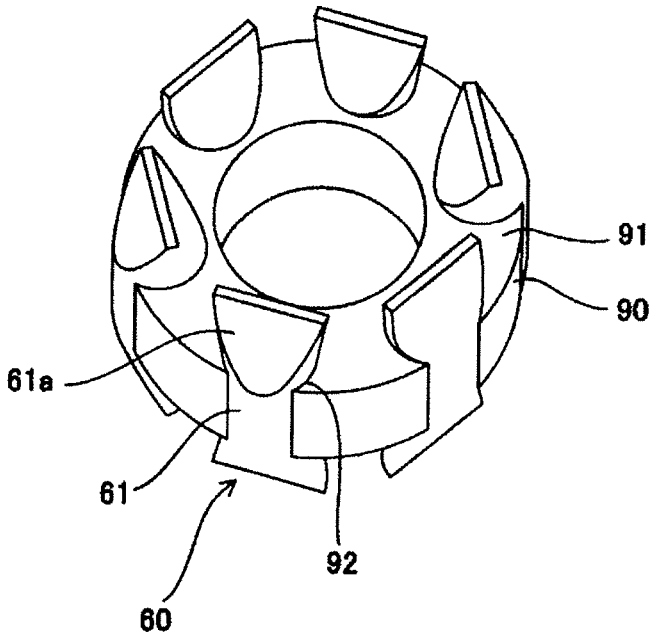
FIG. 9 is an explanatory view showing another embodiment of a holder for a hydrogen getter in detail.

FIG. 9 is an explanatory view showing another embodiment of a holder for a hydrogen getter. In this figure, there are a hydrogen getter 60 and a holder 90. The hydrogen getter 60 is the same as the one in FIG. 6.

The holder 90 is formed with multiple axially extending holes 92 that are spaced from each other in a circumferential direction and extend in a direction parallel to the longitudinal axis of the cathode. The cross section of the holes 92 is semicircular or circular viewed in a direction toward the top surface 91. Each of multiple hydrogen getters 60 is disposed in a respective one of the holes 92 in such a manner that the tapered sealing parts 61*a* formed on both ends of each hollow container 61 extend out of each hole 92 on opposite sides thereof as shown. The portions sticking out of each hole 92 of the holder 90 are deformed such that the width of each sealing part 61*a* of each hollow container 61 becomes wider than that of the hole 92. Accordingly, there is no possibility that the hollow container 61 of each hydrogen getter can fall out of the respective hole 92 of the holder 90.

What is claimed is:

1. A short arc type discharge lamp comprising:

an arc tube, a pair of opposed electrodes disposed directly inside the arc tube, at least one hydrogen getter, the hydrogen getter being composed of a hollow container made of a hydrogen transmissible material and a getter material contained sealed inside the hollow container in an air-tight manner, wherein the hollow container is a curved tube, and a holder that is held on at least one of the electrodes inside of the arc tube and with which the container of said at least one hydrogen getter is fixed on said at least one of the electrodes, wherein the holder is made of a material selected from the group consisting of tungsten, molybdenum and tantalum.

2. The short arc type discharge lamp according to claim 1, wherein the holder is provided with a curved surface part for fixing the hydrogen getter.

3. The short arc type discharge lamp according to claim 1, wherein the holder is provided with a concave recess or hole for fixing the hydrogen getter.

4. The short arc type discharge lamp according to claim 1, wherein the holder is provided with a plurality of concave recesses or holes spaced circumferentially with respect to each other, each of the plurality of concave recesses or holes fixing a respective hydrogen getter therein.

5. The short arc type discharge lamp according to claim 1, wherein the hollow container is a tube with a sealing part closing each of opposite ends in an airtight manner, the sealing part gradually tapering towards a free end part thereof.

6. The short arc type discharge lamp according to claim 1, wherein said at least one of the electrodes comprises a rod-shaped shank and a main body, the main body being connected to an end of the rod-shaped shank, and wherein said holder surrounds said rod-shaped shank.

* * * * *